US005209450A

United States Patent [19]

Grapes

[11] Patent Number: 5,209,450

[45] Date of Patent: May 11, 1993

[54] CHRISTMAS TREE STAND

[76] Inventor: Jacklyn O. Grapes, 344 School St., Romney, W. Va. 26757

[21] Appl. No.: 910,769

[22] Filed: Jul. 8, 1992

[51] Int. Cl.[5] ..... F16M 13/00

[52] U.S. Cl. ..... 249/523; 248/527; 47/40.5

[58] Field of Search ..... 248/523, 524, 527; 47/40.5

[56] References Cited

U.S. PATENT DOCUMENTS

| | | | |
|---|---|---|---|
| 3,987,996 | 10/1976 | Yocca | 248/524 |
| 4,254,578 | 3/1981 | Hanfeld | 248/524 X |
| 4,825,586 | 5/1989 | Coopedge | 248/523 X |
| 4,967,508 | 11/1990 | Reynolds | 47/40.5 |
| 5,014,461 | 5/1991 | vom Brauke et al. | 248/523 X |

*Primary Examiner*—Blair M. Johnson

*Attorney, Agent, or Firm*—Leon Gilden

[57] ABSTRACT

A Christmas tree stand to afford stability and permit stabilization of an associated Christmas tree subsequent to its positioning within the stand structure is arranged to include a base plate having a support cylinder mounted fixedly and medially of the base plate whose axis is orthogonally oriented relative to the base plate. The base plate includes a plurality of leveling threaded rod members directed orthogonally through the base plate about its periphery to afford adjustment permitting leveling thereof subsequent to positioning of a Christmas tree within the support cylinder. The support cylinder is provided with a plurality of adjustable abutment members to engage the tree base. Aromatic fluid filled capsules are located on the abutment members and are activated when the abutment members are adjusted to engage the tree base.

2 Claims, 4 Drawing Sheets

CHRISTMAS TREE STAND

BACKGROUND OF THE INVENTION

1. Field of the Invention

The field of invention relates to support stand apparatus, and more particularly pertains to a new and improved Christmas tree stand wherein the same is directed to the mounting and leveling of a Christmas tree mounted therewithin.

2. Description of the Prior Art

In mounting of Christmas trees within a support structure, typically, the leveling of the tree must be effected simultaneously with its positioning within the associated support structure of the prior art Christmas tree stand, wherein the instant invention attempts to address deficiencies of the prior art to permit leveling of the Christmas tree subsequent to its mounting within the stand structure. Prior art Christmas tree stand structure is addressed in the U.S. Pat. Nos. 4,976,411; 4,901,971; 4,477,049; 4,967,508; and 4,699,347.

The instant invention attempts to address deficiencies of the prior art by providing for a Christmas tree stand structure permitting ease of retrofit adjustment and leveling of the Christmas tree subsequent to its positioning within the stand structure and in this respect, the present invention substantially fulfills this need.

SUMMARY OF THE INVENTION

In view of the foregoing disadvantages inherent in the known types of Christmas tree stand apparatus now present in the prior art, the present invention provides a Christmas tree stand wherein the same utilizes a plurality of leveling screws mounted to the base plate of the Christmas tree stand structure. As such, the general purpose of the present invention, which will be described subsequently in greater detail, is to provide a new and improved Christmas tree stand which has all the advantages of the prior art Christmas tree stand apparatus and none of the disadvantages.

To attain this, the present invention provides a Christmas tree stand to afford stability and permit stabilization of an associated Christmas tree subsequent to its positioning within the stand structure arranged to include a base plate having a support cylinder mounted fixedly and medially of the base plate whose axis is orthogonally oriented relative to the base plate. The base plate includes a plurality of leveling threaded rod members directed orthogonally through the base plate about its periphery to afford adjustment to the organization permitting leveling thereof subsequent to positioning of a Christmas tree within the support cylinder.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved Christmas tree stand which has all the advantages of the prior art Christmas tree stand apparatus and none of the disadvantages.

It is another object of the present invention to provide a new and improved Christmas tree stand which may be easily and efficiently manufactured and marketed.

It is a further object of the present invention to provide a new and improved Christmas tree stand which is of a durable and reliable construction.

An even further object of the present invention is to provide a new and improved Christmas tree stand which is susceptible of a low cost of manufacture with regard to both materials and labor, and which accordingly is then susceptible of low prices of sale to the consuming public, thereby making such Christmas tree stands economically available to the buying public.

Still yet another object of the present invention is to provide a new and improved Christmas tree stand which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
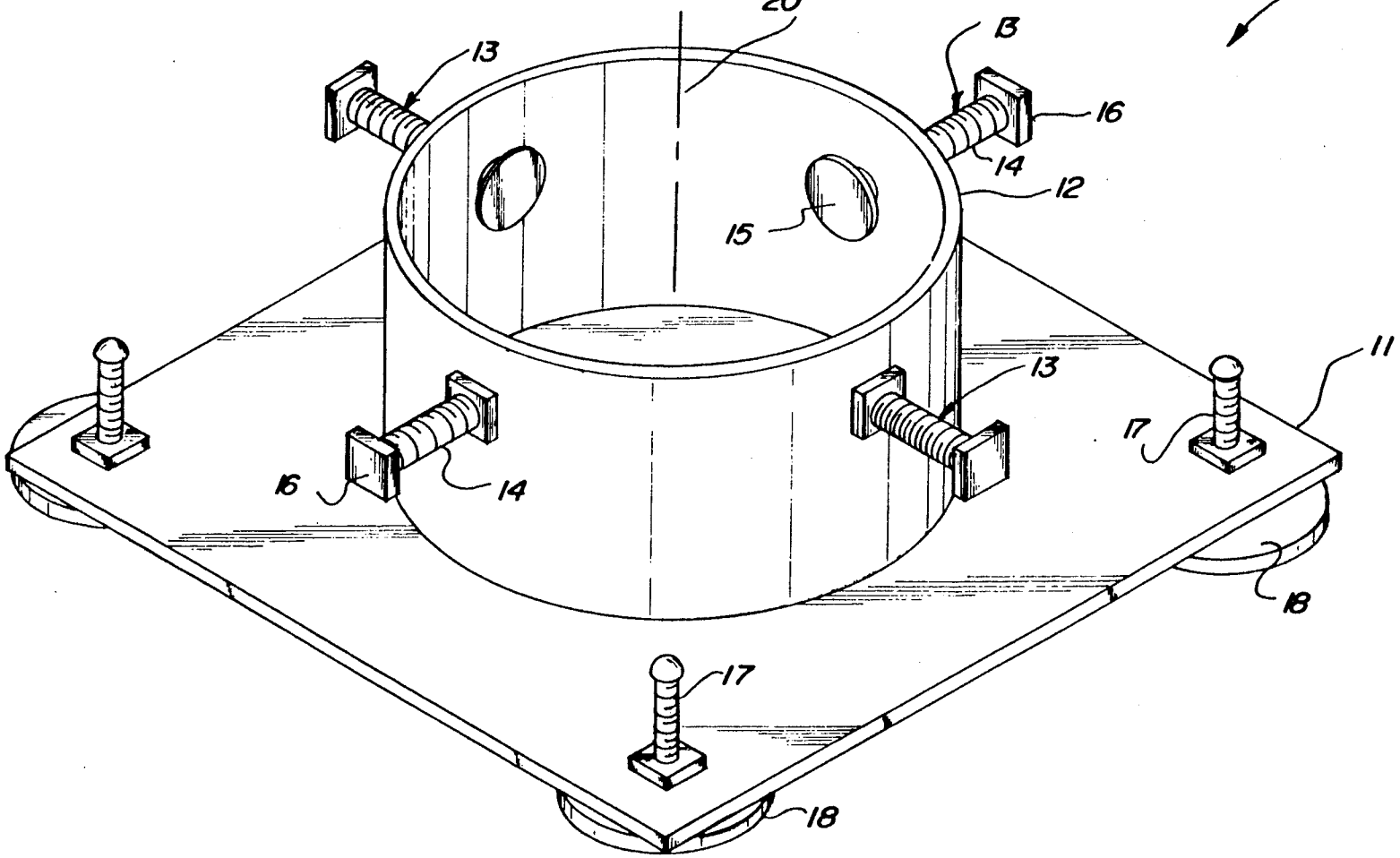
FIG. 1 is an isometric illustration of the instant invention.
Figure 3:
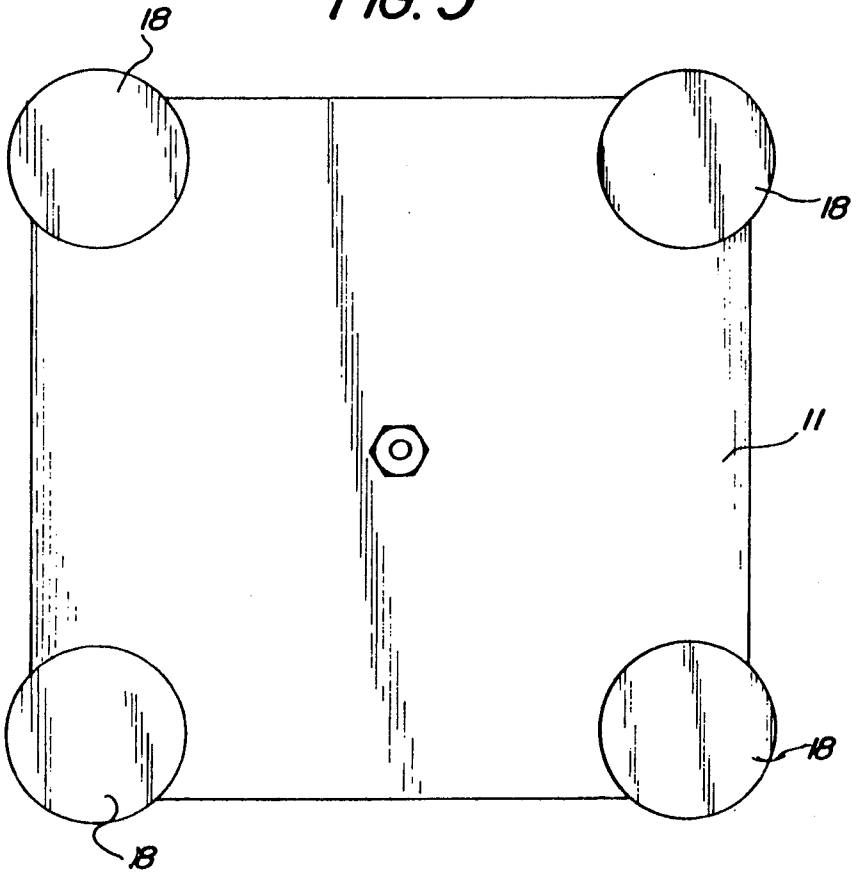
FIG. 3 is an orthographic bottom view of the invention.
Figure 2:
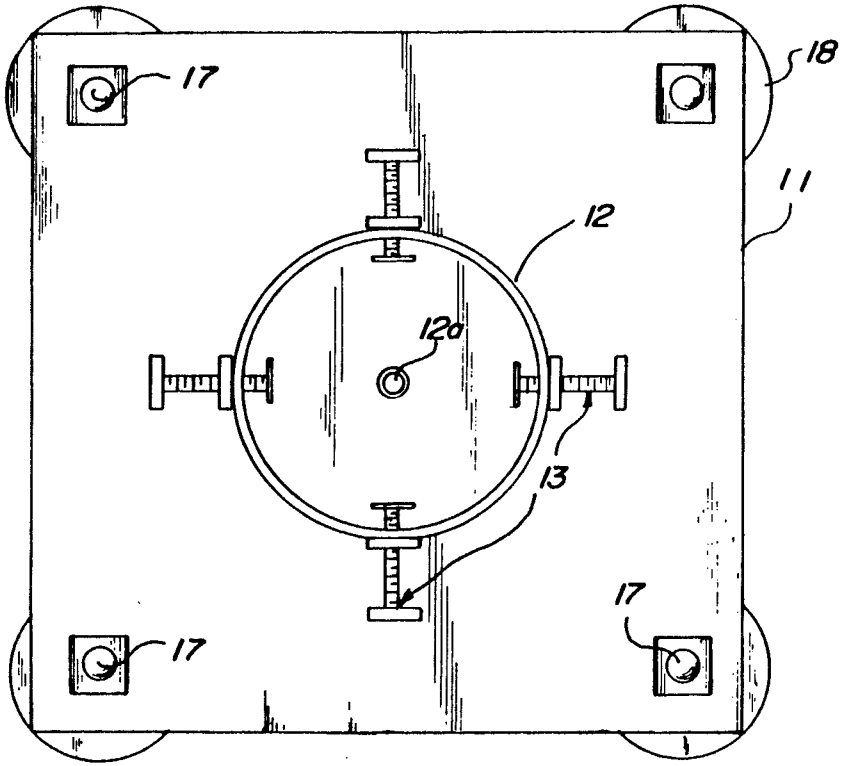
FIG. 2 is an orthographic top view of the invention.
Figure 4:
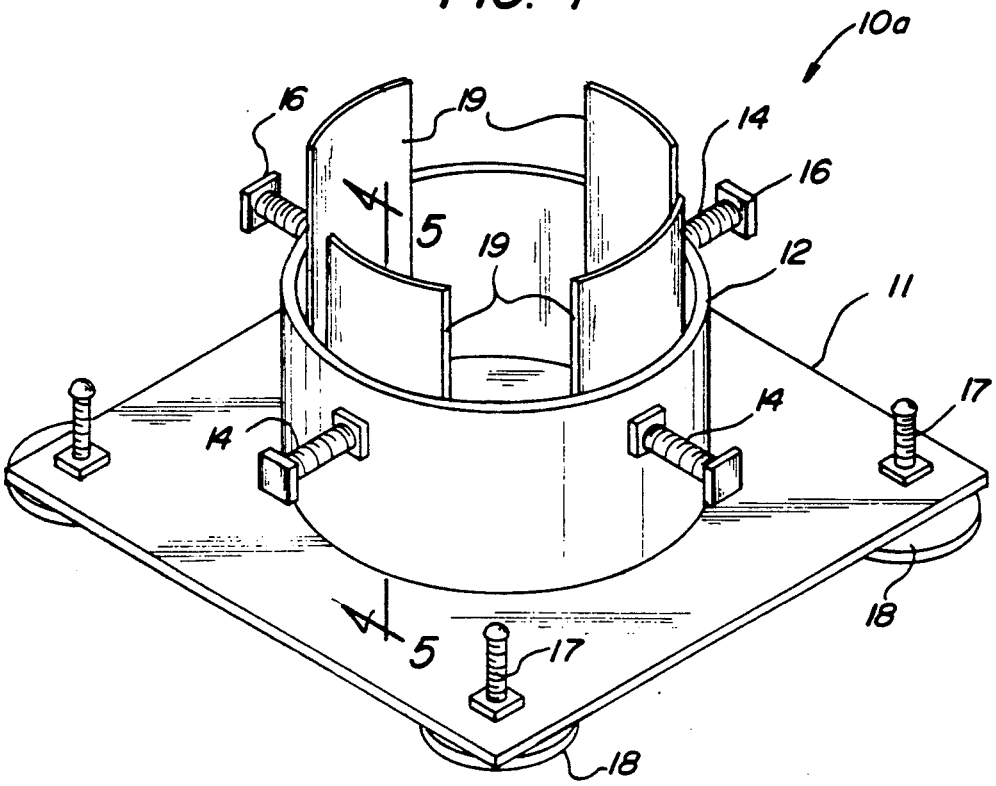
FIG. 4 is an isometric illustration of a modified aspect of the invention.
Figure 5:
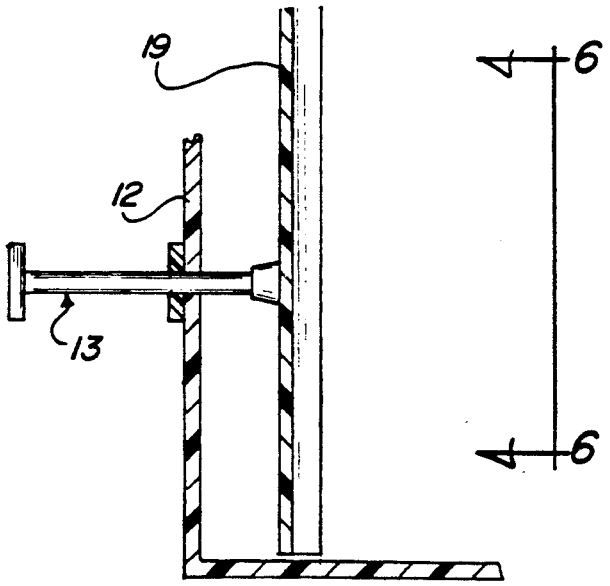
FIG. 5 is an orthographic view, taken along the lines 5—5 of FIG. 4 in the direction indicated by the arrows.
Figure 6:
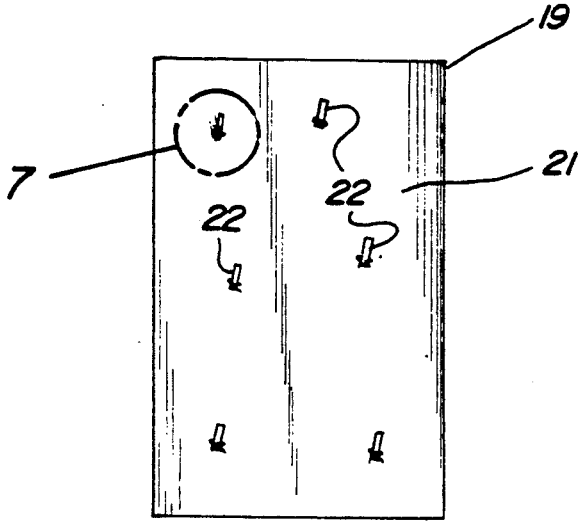
FIG. 6 is an orthographic view, taken along the lines 6—6 of FIG. 5 in the direction indicated by the arrows.
Figure 7:
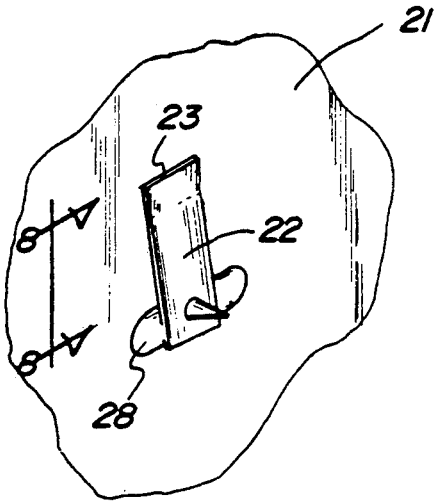
FIG. 7 is an isometric enlarged illustration of section 7 as set forth in FIG. 6.

With reference now to the drawings, and in particular to FIGS. 1 to 8 thereof, a new and improved Christmas tree stand embodying the principles and concepts of the present invention and generally designated by the reference numerals 10 and 10*a* will be described.

More specifically, the Christmas tree stand 10 of the instant invention essentially comprises a base plate 11 having a top surface coextensive with a bottom surface. A support cylinder 12 is fixedly and medially mounted to the top surface, wherein the support cylinder 12 is symmetrically arranged about an axis 20 orthogonally oriented relative to the base plate and to the top surface. A centering pin 12*a* (see FIG. 2) is coaxially aligned with the axis 20 and mounted to the top surface of the base plate 11 within the support cylinder 12. A plurality of abutment members 13 are provided, with each including a threaded rod 14 threadedly directed through the support cylinder 12 radially arranged relative to the support cylinder 12, wherein the abutment members 13 are in an annular array relative to the support cylinder. Each threaded rod 14 includes an abutment plate 15 mounted to an interior end of each threaded rod 14 within the support cylinder 12, with the abutment plate oriented orthogonally relative to each respective threaded rod. A rod handle 16 is mounted to an outer end of each threaded rod exteriorly of the cylinder for ease of manual grasping or rotation of each threaded rod relative to its associated support cylinder 12.

A plurality of height leveling rods 17 that are externally threaded are orthogonally directed through the base plate 11 adjacent the periphery thereof in an equally spaced relationship relative to one another. Each height leveling rod 17 includes a support pad 18 mounted at its lower end, with the support rod orthogonally oriented relative to the bottom surface of the base plate 11. The height leveling rod 17 in this manner permits leveling of a Christmas tree when mounted within the support cylinder 12.

Figure 8:
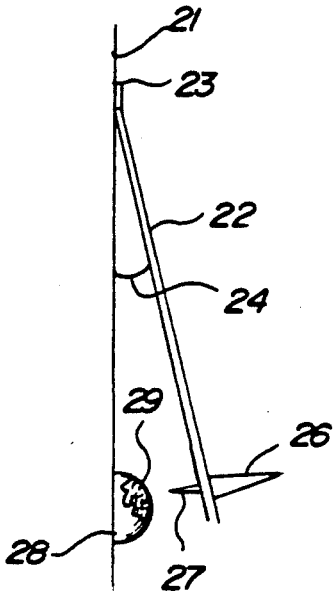
FIG. 8 is an orthographic view, taken along the lines 8—8 of FIG. 7 in the direction indicated by the arrows.

The FIGS. 4–8 illustrate the use of each abutment plate 15 formed as a semi-cylindrical clamp plate 19 coaxially oriented relative to the axis 20 and having a clamp plate concave interior wall 21 oriented towards the axis 20, and wherein the interior wall 21 includes a plurality of engagement plates 22 mounted pivotally thereon. Each engagement plate 22 includes an upper hinge end 23 mounted to the interior wall 21 defining an acute angle between the engagement plate 22 and the interior wall 21. The acute angle 24 is at its orientation, as illustrated in the FIG. 8. Each engagement plate 22 includes an engagement plate lower edge, with a first pin 26 fixedly mounted to the engagement plate and fixedly mounted to an outer face of the engagement plate directed towards the axis 20, with the second pin 27, as illustrated in FIG. 8, mounted to an inner face of the engagement plate 22 positioned in adjacency relative to a capsule 28 and spaced therefrom in a first position. The capsule 28 includes a scented fluid 29 contained therewithin, such as pine scent and the like. In this manner, upon clamping and directing the clamp plates 19 onto an associated Christmas tree to be supported within the organization, the engagement plates 22 are directed towards the interior walls 21 of the clamp plates 19 subsequently rupturing the capsules 28 to dispense scented fluid about a Christmas tree to enhance enjoyment of the tree by releasing a fragrance relative to the tree when mounted within the organization. The capsules 28 are readily replaced for subsequent use in a following year permitting ease of reuse and maintenance of the organization.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Christmas tree stand, comprising, a base plate, the base plate having a top surface coextensive with a bottom surface, and a support cylinder mounted fixedly and medially to the top surface, with the support cylinder defined symmetrically about an axis, with the axis orthogonally oriented relative to the top surface, and a plurality of abutment members radially directed through the support cylinder spaced equally relative to one another in an annular array, with each abutment member having a threaded rod radially directed threadedly through the support cylinder in threaded interengagement with the support cylinder, with the threaded rod having an inner end and an outer end, with the inner end positioned interiorly of the support cylinder, and each inner end including an abutment plate, and each outer end including a rod handle, and a plurality of height leveling externally threaded rods orthogonally and threadedly directed through the base plate, with each of the height leveling rods spaced equally relative to one another adjacent a periphery of the base plate, and each height leveling rod including a rod lower end positioned below the bottom surface, and each height leveling rod lower end including a support pad mounted thereon, and each of the abutment plates are of a semi-cylindrical configuration having a concave interior wall in confronting relationship relative to the axis, and each interior wall includes a plurality of engagement plates, each engagement plate including an engagement plate upper end, and each engagement plate upper end mounted to the interior wall, and each engagement plate having an engagement plate lower edge arranged in a biased relationship relative towards the interior wall, and each engagement plate includes a first pin fixedly mounted to an exterior face of each respective engagement plate oriented towards the axis, and a second pin mounted to an interior face of each engagement plate oriented towards the interior wall of the abutment plate, wherein each engagement plate defines an acute included angle between the engagement plate and the interior wall.

2. A Christmas tree stand as set forth in claim 1 including a fluid filled capsule oriented between each second pin and the interior wall, wherein the fluid is aromatically scented.

* * * * *